US006206189B1

(12) United States Patent
Huot, Jr. et al.

(10) Patent No.: US 6,206,189 B1
(45) Date of Patent: Mar. 27, 2001

(54) DISPLAY CONTAINER HAVING SECURE CLOSURE MECHANISM

(75) Inventors: Henry E. Huot, Jr., Vadnais Heights; Thomas M. Graham, Maplewood, both of MN (US)

(73) Assignee: Huot Manufacturing Company, St. Paul, MN (US)

( * ) Notice: Subject to any disclaimer, the term of this patent is extended or adjusted under 35 U.S.C. 154(b) by 0 days.

(21) Appl. No.: 09/417,493

(22) Filed: Oct. 13, 1999

(51) Int. Cl.[7] ..... B65D 85/20; B65D 45/16

(52) U.S. Cl. ..... 206/379; 206/807; 220/324; 220/835

(58) Field of Search ..... 206/376–379, 206/807, 372, 373, 1.5, 806; 220/324, 326, 835

(56) References Cited

U.S. PATENT DOCUMENTS

| | | | | |
|---|---|---|---|---|
| 4,212,415 | * | 7/1980 | Neely | 220/324 X |
| 4,260,057 | * | 4/1981 | Wall-Andersen | 206/379 |
| 4,606,471 | * | 8/1986 | Quercetti | 220/835 X |
| 4,746,008 | * | 5/1988 | Heverly et al. | 206/1.5 |
| 4,804,082 | * | 2/1989 | Stein | 206/1.5 |
| 5,285,918 | * | 2/1994 | Weisburn et al. | 220/324 X |
| 5,509,528 | * | 4/1996 | Weisburn | 206/806 X |
| 5,577,779 | * | 11/1996 | Dangel | 220/326 X |
| 5,758,769 | * | 6/1998 | Vasudeva | 206/372 |

FOREIGN PATENT DOCUMENTS

2190661 * 11/1987 (GB) .

* cited by examiner

*Primary Examiner*—Bryon P. Gehman

(74) *Attorney, Agent, or Firm*—Moore & Hansen

(57) ABSTRACT

The present invention provides a display container for retaining retail sales products. The display container includes a housing having a bottom portion having a plurality of sides and a top portion which can engage the bottom portion to form an enclosure within which the retail merchandise can reside. The housing is in a closed orientation when the top portion is engaged with the bottom portion. The top portion is preferably interconnected with one of the plurality of sides of the bottom portion so that the top portion can engage the bottom portion to form the enclosure. The housing further includes a tamper proof clasp or snap closure mechanism. The snap closure mechanism includes a latch strap and a lip over which the latch strap can extend, the latch strap having a strap surface extending away from a first portion. The latch strap further includes a catch protruding away from the strap surface to define a catch face generally extending away from the strap surface at an angle of about 90°. When the top portion is engaged with the bottom portion to form the enclosure, the catch face can engage the lip such that the latch strap engages the lip and holds the enclosure in the closed orientation. The snap closure mechanism further includes a containment bridge under which at least an end portion of the latch strap extends when the latch strap engages the lip, the containment bridge extending from a first location to a second location on the housing proximate the lip, and generally restricts the movement of the strap away from the lip when the catch face is engaged with the lip such that the catch face cannot be disengaged from the lip without destroying the containment bridge. In preferred embodiments the housing is made of a synthetic polymeric material through which retail merchandise contained within the housing can be seen. In more preferred embodiments the housing contains a tool bit display panel for receiving, retaining and displaying tool bits. Further preferred elements include the housing having a tab having a hook receiving receptacle for hang the display container on a display hook.

15 Claims, 5 Drawing Sheets

DISPLAY CONTAINER HAVING SECURE CLOSURE MECHANISM

BACKGROUND OF THE INVENTION

The present invention relates generally to a container for holding, storing and displaying tool bits, such as drill bits, driver bits, hex bits, bit holders and the like. Typical tool bit holders are opaque thereby imposing limitations on displaying their contents in a retail setting. Specifically, in order to attract a consumer, the holders are often packaged in an open position and shrink-wrapped to show their contents and to prevent the tool bits from falling out or being stolen. Alternatively, the holders are displayed as part of a kit in a large, molded plastic, disposable container which displays the holder in the closed position and each individual tool bit in an exploded view outside of the holder. The consumer, after purchasing the kit, must remove each bit from the display container and place it in the holder. It would be desirable to develop a tool bit index which serves as both a storage container and a display case suitable for retail environments.

Accordingly, it will be appreciated that there is a need for better containers for displaying retail merchandise of this type. The present invention provides advantages over the prior containers and also offers other advantages over the prior art and solves other problems associated therewith.

SUMMARY OF THE INVENTION

The present invention provides a merchandise display container for retaining retail sales products. The preferred display container includes a housing having a bottom portion having a plurality of sides and a top portion which can engage the bottom portion to form an enclosure within which the retail merchandise can reside. The top portion is preferably interconnected with one of the plurality of sides of the bottom portion so that the top portion can engage the bottom portion to form the enclosure. In preferred embodiments the housing is made of a synthetic polymeric material through which retail merchandise contained within the housing can be seen and it preferably includes a "tamper proof" clasp or snap closure mechanism. The "temper proof" snap closure mechanism has first and second elements. The first element is a part of a first portion of the housing and the second element is a part of a second portion of the housing. The first portion is selected from one of the group consisting of the top portion and the bottom portion, and the second portion is the other. The first element includes a latch strap. The latch strap is an extension of the first portion and has a strap surface extending away from the first portion. The latch strap further includes a catch protruding away from the strap surface to define a catch face generally extending away from the strap surface at an angle of generally about 90°. The second element includes a lip on the second portion over which the latch strap can extend when the top portion is engaged with the bottom portion to form the enclosure, wherein the catch face of the first element can engage the lip of the second element such that the latch strap engages the lip and holds the enclosure in a closed orientation or position. The housing is in the closed position when the top portion is engaged with the bottom portion. The second portion further includes a containment bridge under which at least an end portion of the latch strap extends when the latch strap engages the lip. The containment bridge extends from a first location to a second location on the outer surface of the second portion proximate the lip, and generally restricts the movement of the strap away from the lip when the catch face is engaged with the lip such that the catch face cannot be disengaged from the lip without destroying the containment bridge.

In more preferred embodiments, the housing contains a tool bit display panel for receiving, retaining and displaying tool bits; a lower portion of the tool bit display panel is pivotally interconnected with the bottom portion of the housing such that the tool bit panel can pivot with respect to the bottom portion, thereby affording improved access to an upper portion of the tool bit panel when the top portion of the housing is not engaged with the bottom portion to form the enclosure and the upper portion of the panel is pivoted away from the bottom portion. The tool bit panel provides a plurality of tool bit receiving receptacles for receiving and retaining tool bits. Other preferred elements include the housing having a living hinge connecting the top portion with the bottom portion; the housing having a pair of protrusion receiving openings in the bottom portion of the housing; and the display panel having a pair of extruded metal protrusions extending outwardly from opposite sides of the panel, the metal extrusions being seated within respective extrusion receiving openings to enable the panel to pivot with respect to the bottom portion. Further preferred elements include the housing having a hanger tab; the hanger tab having a hook receiving receptacle for hang the display container or index on a merchandise display hook.

In further preferred embodiments, the housing has a top surface and a bottom surface and four sides, three of the sides being generally oriented at an angle of about 90° with respect to at least one of the other sides and the fourth side being oriented at angles with respect to each of the other sides which are other than 90°. In further preferred embodiments the tool bits are drill bits and in further embodiments the housing is made of a synthetic polymeric material which can be cut and separated from the housing, the containment bridge being severable such that the strap can be pull away from the lip, thereby disengaging the catch face from the lip and permitting the disengagement of the top portion from the bottom portion.

Advantageously, the preferred container of the present invention generally provides an index for storing tool bits of various types and sizes, preferably a series of drill bits.

It is another advantage of the invention to provide a display container or an index which is suitable for use as a retail display case.

It is also a characteristic of the invention to provide a display container or an index which minimizes the tampering and accidental opening.

It is yet another advantage of the invention to provide a display container or a tool bit index which prevents opening by a consumer while the container or index is in a retail environment.

It is still another characteristic of the invention to provide a display container or a tool bit index which has at least one transparent surface so that all of the contents of the a display container or index may be viewed without opening the same.

It is also an advantage of the invention to provide a display container or a tool bit index that is relatively inexpensive to manufacture and provides pricing advantages to OEM manufacturers.

In preferred embodiments, the present invention provides an improved container or index for both storing and displaying tool bits. The display container or tool bit index of this invention is preferably formed from a clear plastic material such that its contents may be viewed even when the container or index is in a closed position. Furthermore, in order to prevent the index from opening while on display in a retail store, the containment bridge covers the catch mechanism, thereby blocking the movement required to open the catch mechanism. The containment bridge may be cut away by the consumer after purchasing the container or index so that the same may be opened and closed freely and repeatedly. It is envisioned that preferred embodiments of the top portion of the housing are integral with one of the plurality of sides of the bottom portion, thereby forming a living hinge which flexes when opening and closing the container or index. Alternatively, any known hinge configuration could be used to facilitate a door-like relationship between the top portion and the bottom portion.

The tool bit panel of the preferred embodiment preferably has an upper portion which receives the tool bits and a lower portion which is pivotally interconnected with the bottom portion of the housing such that the tool bit panel can pivot with respect to the bottom portion. This configuration affords improved access to the upper portion of the tool bit panel when the top portion of the housing is not engaged with the bottom portion to form the enclosure and the upper portion of the panel is pivoted away from the bottom portion. The upper portion of the tool bit panel preferably has a plurality of tool bit receiving receptacles or openings for receiving and retaining tool bits.

The housing is maintained in a closed position by a snap closure mechanism. The snap closure mechanism has first and second elements, the first element being a part of a first portion of the housing and the second element being a part of a second portion of the housing, the first portion being one of the group consisting of the top portion and the bottom portion, and the second portion being the other.

The first element of the snap closure mechanism includes a latch strap which is an extension of the first portion and has a strap surface extending away from the first portion. The latch strap has a catch protruding away from the strap surface to define a catch face generally extending away from the strap surface at an angle of generally about 90 degrees. The second element has a lip on the second portion over which the latch strap can extend when the top portion is engaged with the bottom portion to form the enclosure. The catch face of the first element can engage the lip of the second element such that the latch strap, engaged with the lip, holds the enclosure in the closed orientation.

The second portion includes a containment bridge under which at least an end portion of the latch strap extends when the latch strap engages the lip. The containment bridge extends from a first location to a second location on the second portion, proximate the lip, and generally restricts the movement of the strap away from the lip when the catch face is engaged with the lip, such that the catch face cannot disengage from the lip because the strap is held generally in place by the containment bridge.

These and other objectives, advantages and features of novelty that characterize the present invention will be described more fully in the following description, made in conjunction with the accompanying drawings wherein like and primed reference numerals and characters refer to the same or similar parts throughout the several views. And, although the disclosure hereof is detailed and exact to enable those skilled in the art to practice the invention, the physical embodiments herein disclosed merely exemplify the invention which may be embodied in other specific structure. While the preferred embodiment has been described herein, the details may be changed without departing from the invention, which is defined by the claims which form a further part hereof.

BRIEF DESCRIPTION OF THE DRAWINGS

The present invention will be further described in connection with the accompanying drawings, in which:

FIG. 3 is a top plan view of the housing of the preferred embodiment of the present invention shown in FIG. 1, except that the top portion is disengaged from the bottom portion in a manner as might be expected prior to assembly and closure of the preferred display container or index of the present invention;

DETAILED DESCRIPTION OF THE PREFERRED EMBODIMENTS

Figure 1:
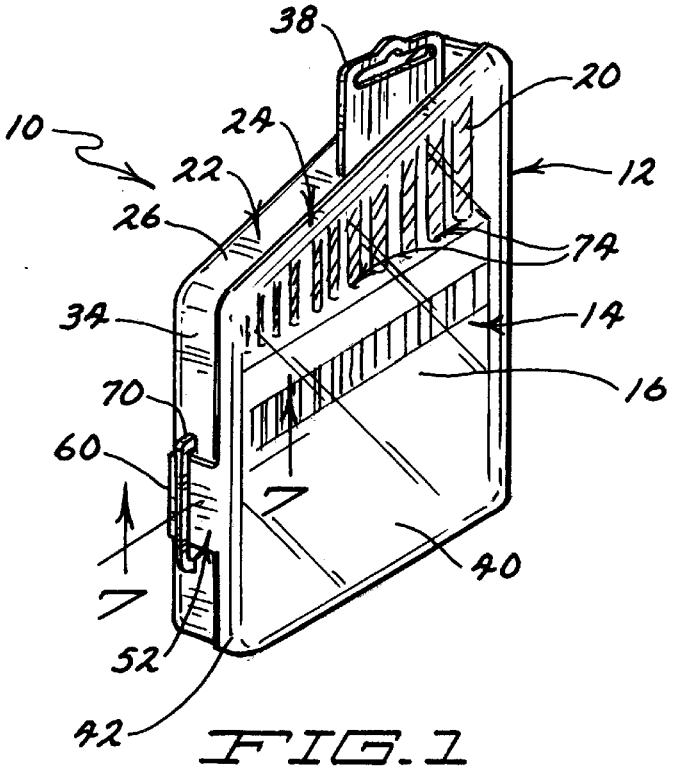
FIG. 1 a perspective view of the preferred embodiment of the present invention wherein the top portion is engaged with the bottom portion to form the enclosure.
Figure 2:
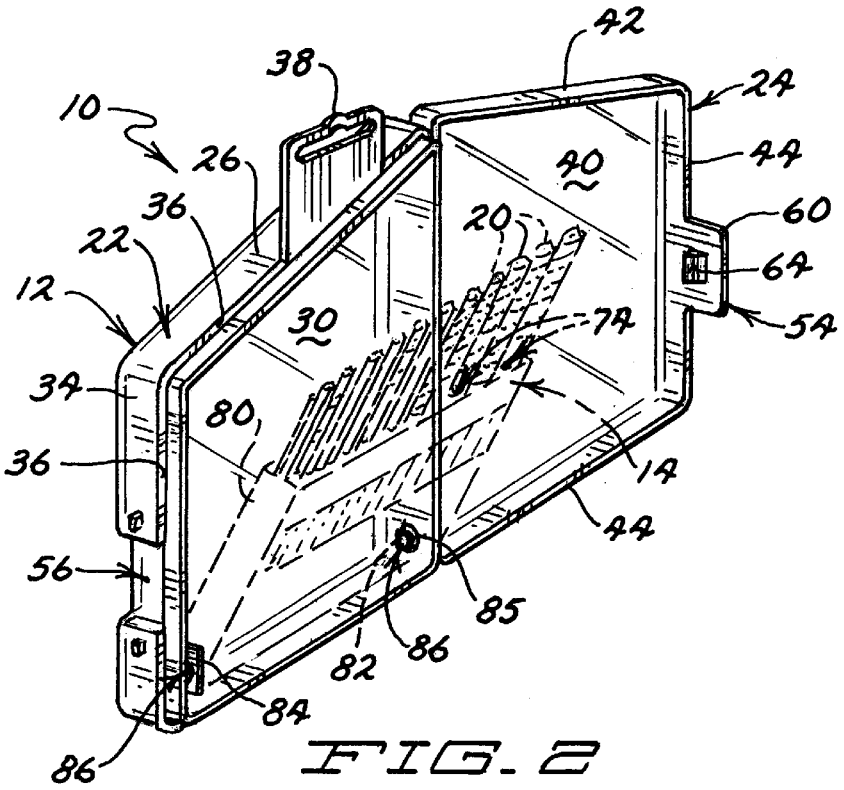
FIG. 2 is a perspective view of the preferred embodiment of the present invention similar to that shown in FIG. 1, except that the top portion is disengaged from the bottom portion, the containment bridge is broken and the tool bit panel, shown in hidden line, is pivoted forward, thereby providing access to drill bits, which are also shown in hidden line.

Referring now to FIGS. 1 and 2, a tool bit index 10 is shown including a housing 12 and a tool bit panel 14. FIG. 1 shows tool bit index 10 in a closed position, thereby creating enclosure 16 which contains tool bit panel 14. FIG. 2 shows tool bit index 10 in an open position, allowing panel 14 to pivot outwardly, thereby providing access to any tool bits 20 contained therein. It will be appreciated that the present tool bit index 10 is preferred merchandise display container of the present invention, but the other display containers are also envisioned which contain other merchandise. Furthermore, although the preferred tool bit index 10 is designed to retain drill bits 20, other tool bits can also be retained in this or other embodiments.

In preferred embodiments, the housing 12, and the merchandise display container or tool index 10 of the present invention, will be made primarily, if not entirely, of synthetic polymeric material, preferably a clear or at least translucent synthetic polymer such as polystyrenes, polybutadienes, polyacrylonitriles, polyethylene terephthalates, polyolefins or the like, or combination thereof, preferably thermoplastic copolymers including polypropylene, polyethylene, polybutylene, or the like, and combinations thereof. In the most preferred embodiments the synthetic polymer will be a synthetic polymeric material through which retail merchandise within the display container can be seen.

Figure 4:
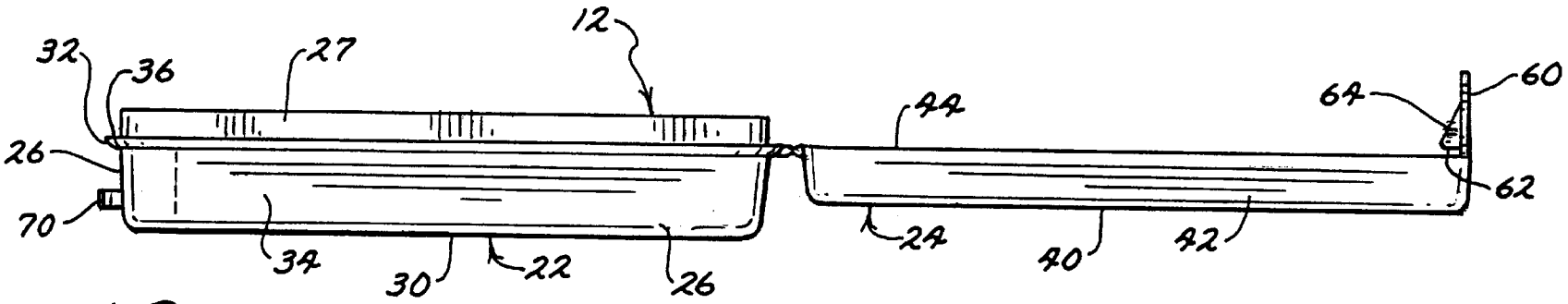
FIG. 4 is a front side elevational view of the housing of the preferred embodiment of the present invention shown in FIG. 1, except that the top portion is disengaged from the bottom portion in a manner as might be expected prior to assembly and closure of the preferred display container or index.
Figure 5:
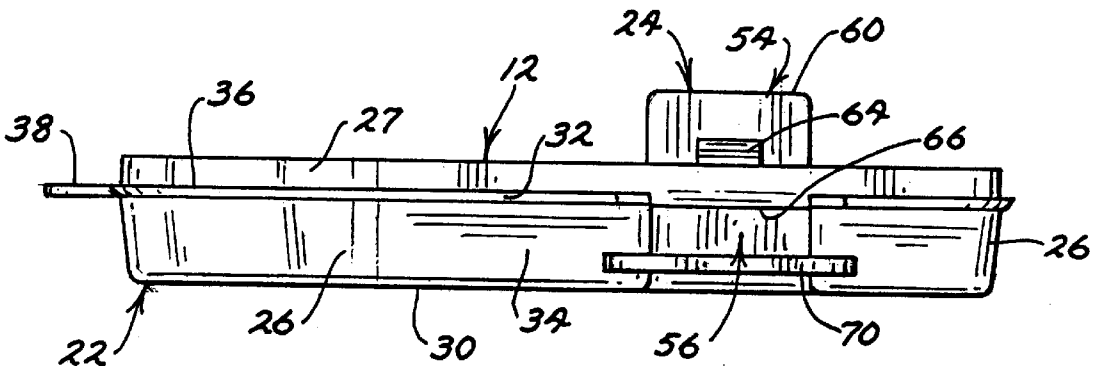
FIG. 5 is a right side elevational view of the housing of the preferred embodiment of the present invention shown in FIG. 4 wherein the top portion is disengaged from the bottom portion prior to assembly and closure of the preferred display container.

Referring now also to FIGS. 3–6, the housing 12 specifically includes a bottom portion 22 and a top portion 24. Bottom portion 22 has a plurality of bottom portion walls 26 extending outwardly from a back panel 30. Preferably, a mating flange 32 is integral with the outside surface 34 of walls 26 and forms an abutment surface 36. As shown in FIGS. 4 and 5, mating flange 32 is a ridge-like discontinuity on the otherwise, substantially planar outside surface 34 of walls 26. Mating flange 32 extends from abutment surface 36 to back panel 30, thereby forming outer surface 34 of walls 26. It is envisioned that a hanger tab 38 extends from mating flange 32 in order to allow tool index 10 to be hung from a merchandise display hangar (not shown) such as that of a retail display case or a tool retaining peg board surface in a workshop.

As seen in FIG. 3, top portion 24 has a similar shape to that of bottom portion 22 for conformity therewith, but is enlarged enough to fit around an upper portion 27 of walls 26 which extend above the abutment surface 36 of the mating flange 32 when the top portion 24 is engaged with the bottom portion 22. Top portion 24 has a front panel 40 with top portion walls 42 extending outwardly from the perimeter of panel 40. Walls 42 have an outer edge 44 which abuts abutment surface 36 when tool index 10 is in a closed position or orientation.

Top portion 24 is operably connected to bottom portion 22 by hinge 46. Though hinge 46 is depicted in the preferred embodiment by an extension or "living hinge" which is integral with both a bottom portion wall 26 and a top portion wall 42, it is envisioned that any suitable hinge mechanism or hinge structure can be used. Hinge 46 allows top portion 24 to pivot about hinge 46 and mate with bottom portion 22 to define a closed position. When tool index 10 is closed, an enclosure 16 is formed. Enclosure 16 is defined by the back panel 30, front panel 40, bottom portion walls 26, and top portion walls 42. Tool index 10 is considered fully closed and in the closed position when abutment surface 36 of bottom portion 22 abuts outer edge 44 of top portion 24.

Figure 9:
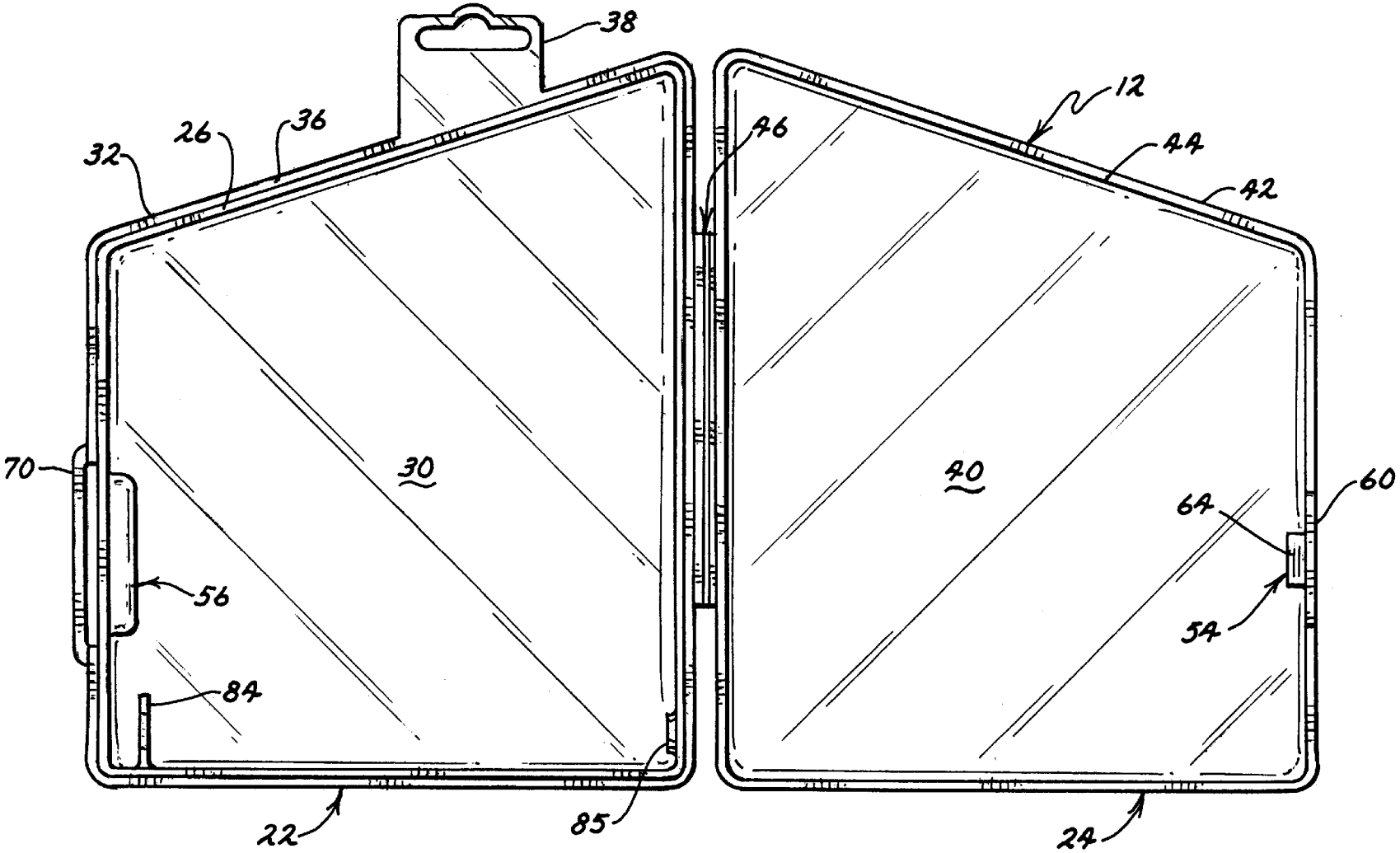
FIG. 9 is a top plan view of an alternate embodiment of a further housing of the present invention.
Figure 8:
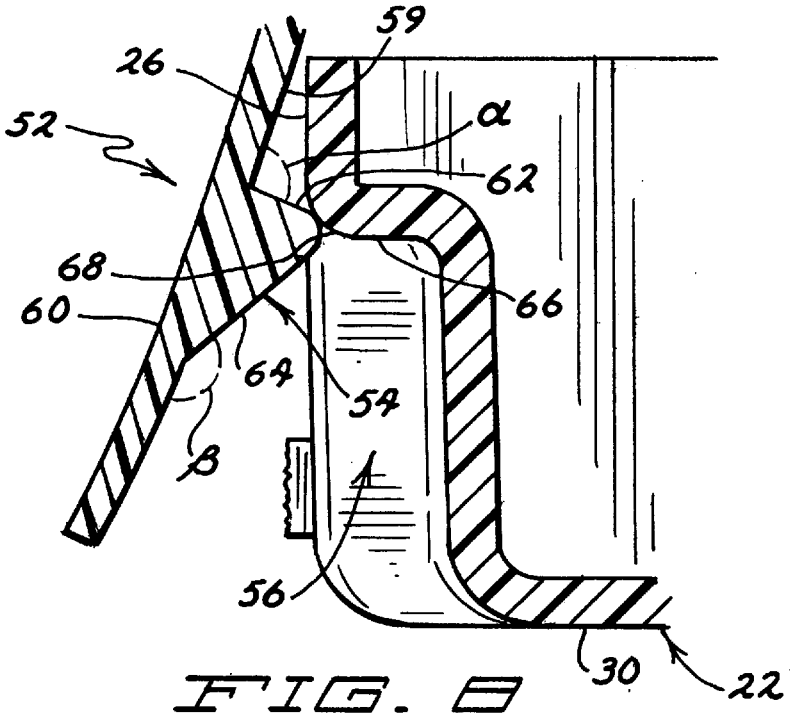
FIG. 8 is the partial cut-away view similar to that of FIG. 7, but showing the containment bridge broken away and showing the general relationship of elements of snap mechanism during opening or closing operation.
Figure 7:
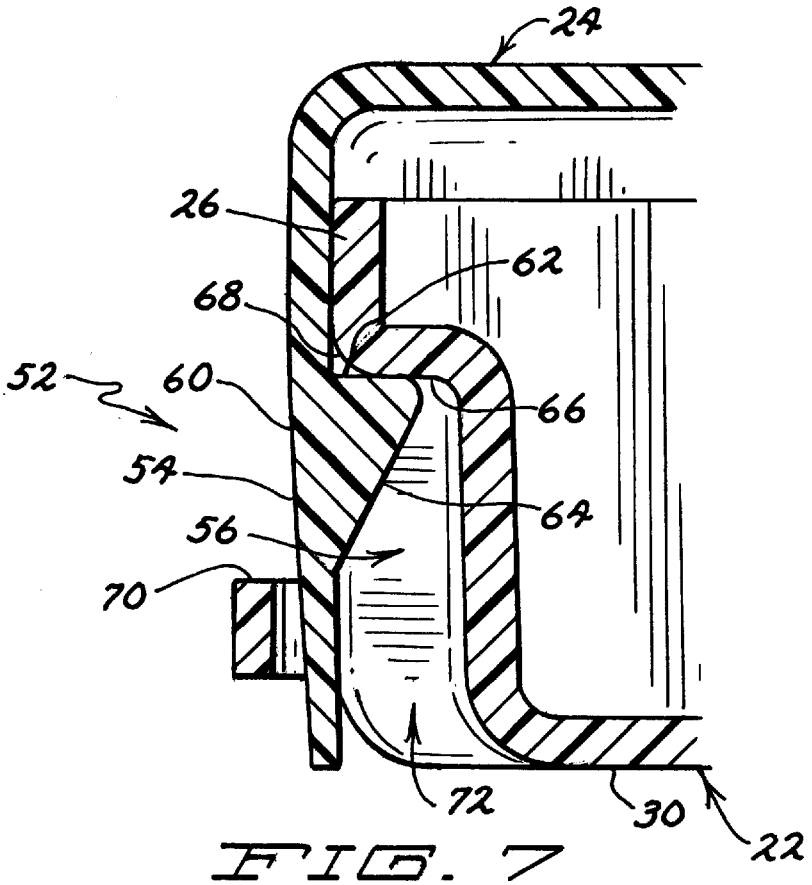
FIG. 7 is a partial cross-sectional view of the snap mechanism of the preferred embodiment of the present invention as seen generally from line 7—7 of FIG. 1.
Figure 5:
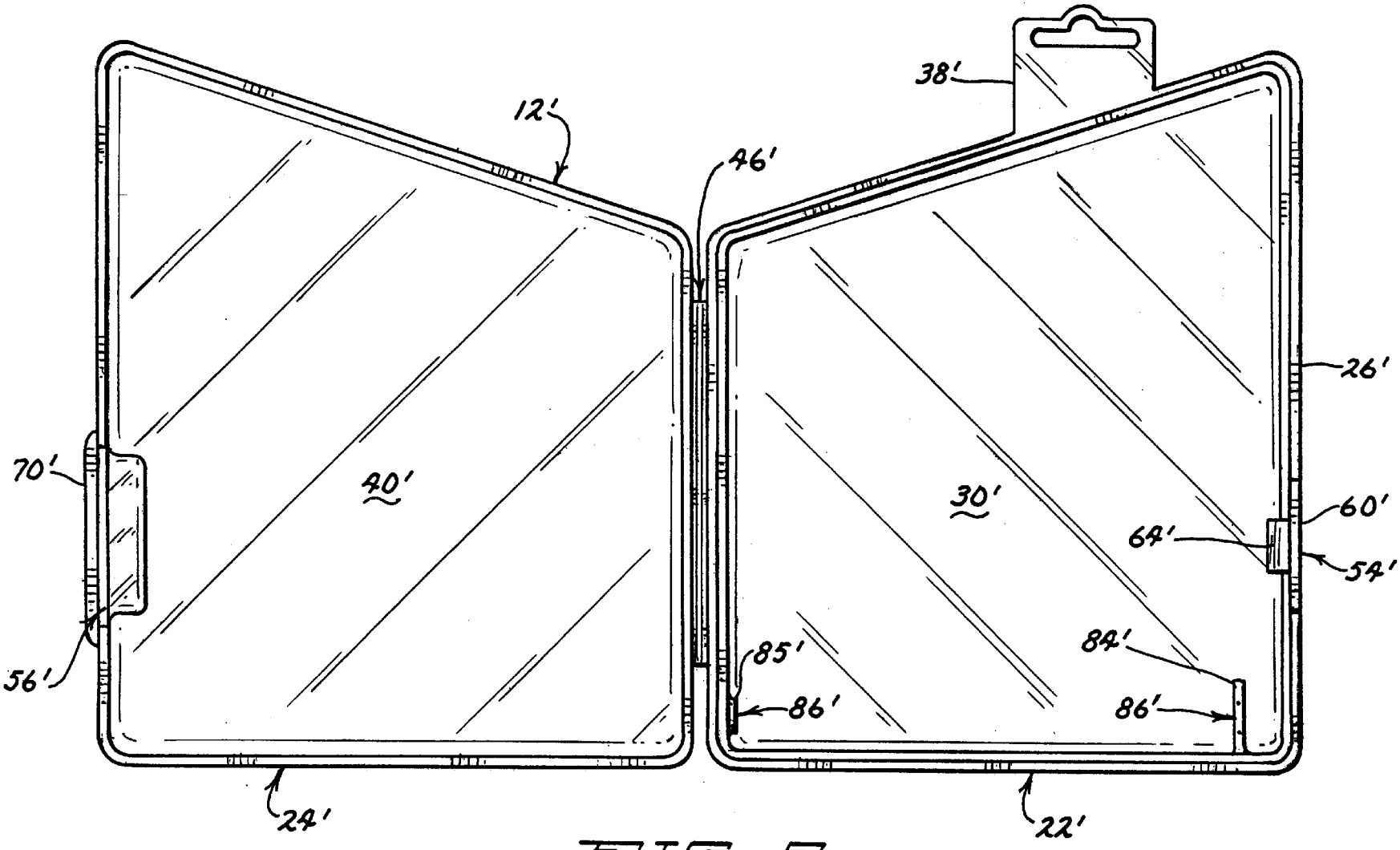

Referring now also to FIGS. 7 and 8, tool index 10 is kept in a closed position by a snap mechanism 52. Snap mechanism 52 is best shown in FIG. 7 and includes a catch 54 and a catch receiver 56. It is envisioned that, in alternate embodiments, catch 54 could extend from either a top portion wall 42 or a bottom portion wall 26 with catch receiver 56 being thereby formed into bottom portion wall 26 or top portion wall 42, respectively. FIG. 3 depicts an embodiment wherein catch 54 extends from a bottom portion wall 26 and catch receiver 56 extends from a top portion wall 42. FIG. 9 shows an alternate embodiment wherein catch 54' extends from a top portion wall 42' and catch receiver 56' extends from a bottom portion wall 26'.

Figure 6:
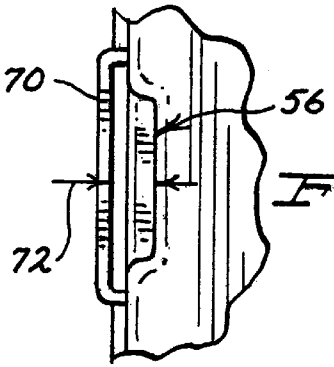
FIG. 6 is an enlarged broken away partial top plan view of the containment bridge and engagement lip of the preferred embodiment of the present invention shown in FIGS. 4 and 5.

In order to prevent the housing 12, 12' from opening accidentally while in a retail environment, it is envisioned that housing 12, 12' will include a containment bridge 70, 70'. Containment bridge 70, 70' is preferably molded from the same material used to form housing 12, 12'. Containment bridge 70, 70' is an elongate bridge extending from a bottom portion wall 26, 26' proximate one side of catch receiver 56, 56', over catch receiver 56, 56' and reconnecting with bottom portion wall 26, 26' proximate the other side of catch receiver 56, 56'. At mid span, containment bridge 70, 70' is separated from catch receiver a predetermined amount to create a gap 72, 72' between containment bridge 70, 70' and catch receiver 56, 56' as best seen in FIGS. 6 and 7. Gap 72, 72' must be of sufficient size to accommodate latch strap 60 when merchandise display container or index of the present invention is in a closed position. Additionally, gap 72, 72' must be small enough to prevent latch strap 60 from being pulled away from the catch receiver 56, 56' enough to allow catch 54, 54' to separate from catch face mating surface 66, 66' to slide over lip 68, and thereby open the closed housing or enclosure 12, 12'. Additionally, containment bridge 70, 70' is preferably thin enough to allow removal of the bridge 70, 70' using a scissors, knife or other sharp object, without otherwise damaging housing 12, 12'. Once containment bridge 70, 70' is properly removed, latch strap 60, 60' is unimpeded and the display container or index can be opened and closed repeatedly.

Catch 54 extends inwardly from a latch strap 60. Catch 54 is shaped to form a catch face 62 extending inwardly from a latch strap 60 at a substantially perpendicular angle $\alpha$ which is generally about ninety degrees to the inner surface 59 of latch strap 60. Catch 54 tapers back to latch strap 60 opposite catch face 62, to form angled face 64. Angled face 64 joins latch strap 60 at an outside angle $\beta$ which is preferably greater than ninety degrees but less than one hundred eighty degrees. Angle $\beta$ is more preferably between about 135 and 170 degrees. The latch strap 60 is engaged with the catch receiver 56 when the display container or index 10 is in a closed position.

When presented to consumers in a retail setting the latch strap 60 is secured by containment bridge 70 extending away from the outside surface 34 of the bottom wall portion 26. Unless the containment bridge 70 is destroyed or otherwise broken or disconnected from the housing 12, the latch strap 60 cannot be raised in order to disengage the catch face 62 from the catch receiver 56. In order to open the display container 10, therefore, a purchase will need to clip the ends of the containment bridge 70 to separate it from the housing 12. When the containment bridge 70 is separated from the housing, the latch strap 60 can be easily lifted to disengage the catch 54 from the catch receiver 56. In this way, the display containers of the present invention are "tamper proof" so long as the containment bridges remain intact. Because the preferred container will be made of synthetic polymers through which the consumer will be able to see the merchandise within the container, there will be no real need for the consumer to open the container until it has been purchased. The combination of the "tamper proof" catch mechanism and the "see-through" nature of the container will help retailers reduce product tampering while providing consumers with visual inspection capability to confirm the contents of the container prior to purchase.

Catch receiver 56 preferably includes an indentation in bottom portion wall 26, or, alternatively, in top portion wall 42' as seen in the embodiment shown in FIG. 9 to form catch face mating surface 66. Catch face mating surface 66 extends inwardly from bottom portion wall 26 in a manner so that it will "mate" with catch face 62. A lip 68 is defined by the intersection between catch face mating surface 66 and outside surface 34 of bottom portion wall 26 proximate mating surface 66. When tool index 10 is in a closed position, catch face 62 abuts against catch face mating surface 66 in such a manner as to prevent tool index 10 from opening without the application of force to disengage the latch strap 60 and the latch strap catch face 62 from the lip 68 and catch face mating surface 66. It will be appreciated that the latch strap 60 cannot be disengaged from catch receiver 56 while containment bridge 70 is in place. As stated above, however, once the containment bridge 70 is severed, the latch strap 60 is easily engaged and disengaged with the catch receiver 56.

In operation, when closing tool index 10 after containment bridge 70 severed away from the housing 12, top portion 24 is pivoted around hinge 46 toward bottom portion 22. Eventually, top portion 24 engages bottom portion 22 and latch strap 60 can be "snapped shut" across the catch receiver 56 such that the catch face 62 engages the catch face mating surface 66. It is believed, that in the process catch receiver 56, and perhaps other portions of bottom portion 22 and even portions of top portion 24 will deform somewhat to allow the latch strap 60 to fully engage the catch receiver 56.

During manufacture and assembly of display container or index 10, housing 12 is preferably made in an injection molding process. When the molding process is completed, housing 12, shown in FIGS. 3 and 4, or the alternative housing 12', shown in FIG. 9, the housing is ready for further assembly and/or packaging. In alternate embodiments housing 12 and 12' are simply closed after placing merchandise of one kind or another into the housing 12, 12'. In the one case, the alternate merchandise display containers (not shown) provide simple tamper proof packaging available to display merchandise in retail outlets. The only steps involved are placing the merchandise in the housing 12, 12' and closing the housing 12, 12'.

In the most preferred embodiment shown in FIG. 1, tool bit panel 14 is inserted into the housing 12, tool bits are then inserted into tool bit panel 14 and then the housing 12 is closed. The same steps are followed in assembling an alternate tool bit index (not shown) from the alternate housing 12'. The process for closing each of the housings 12, 12' of the present invention are generally the same, although some of the parts of the respective housings 12, 12' are in different places relative to one another, and have somewhat different orientations with respect to one another.

In closing housing 12, top portion 24 is pivoted with respect to bottom portion 22 about hinge 46 from the open position shown in FIG. 4 toward the closed position shown in FIG. 1. The cross-sectional view of catch 54 engaged with catch receiver 56, shown in FIG. 7, illustrates the relationship between catch 54, catch receiver 56 and containment bridge 70 when housing 12 is in the closed position. In order to insert the distal end of latch strap 60 into the gap 72 between containment bridge 70 and a recessed portion 73 of bottom portion walls 26 proximate catch receiver 56, it is believed that it is necessary to deform portions of both of the top portion 24 and the bottom portion 22. This deformation occurs as latch strap 60 is inserted between containment bridge 70 and lip 68 and the various other elements of the catch receiver 56. It is uncertain as to exactly how the various elements of housing 12 deform to allow latch strap 60 to become fully engaged with catch receiver 56, but it is believed that containment bridge 70 is deformed are portions of bottom portions 22 on either side of lip 68, as latch strap 60 is forced in to the gap 72. At the same time, angled face 64 of catch 54 is believed to contact bottom portion wall 26 proximate catch receiver 56. As top portion 24 is pressed toward bottom portion 22, angled face 64 of catch 54 is believed to act against the bottom portion wall 26 proximate catch receiver 56, thereby temporarily deforming both catch 54 and catch receiver 56 such that latch strap 60 is deflected outwardly and lip 68 is deflected inwardly and other portions of bottom portion 22 are believed to be deformed along with other portions of the top portion 24. This deformation is believed to continue until top portion 24 reaches a closed position, whereby the outer edge 44 of top portion walls 42 abut against abutment surface 36 of mating flange 32. In this closed position, catch 54 follows catch face mating surface 66 until catch face 62 slides over lip 68 and abuts catch face mating surface 66, thereby releasing any stresses due to deformation.

To open the container or tool index 10, containment bridge 70 must be cut away. After the containment bridge has been destroyed, latch strap 60 is pulled outwardly until catch face 62 separates from catch face mating surface 66 and clears lip 68. The top portion 24 may then be rotated up and away from bottom portion 22, pivoting about hinge 46.

Housing 12 may be constructed, preferably molded, from any known plastic, thermoplastic, plastomer or similar material. Preferable materials include polystyrenes, polybutadiencs, polyacrylonitriles, polyethylene terephthalates, polyolefins or the like, or combination thereof, preferably thermoplastic copolymers including polypropylene, polyethylene, polybutylene, or the like, and combinations thereof. Additionally, it will be appreciated that such copolymers may include other monomers. The chosen material will preferably be clear in order to allow a consumer to view the contents of the display container or index without opening same. In preferred embodiments of the present invention, a tool bit panel 14 is contained within housing 12. In the preferred embodiment shown in FIGS. 1 and 2, tool bit panel 14 defines a plurality of openings 74 for receiving and containing various tool bits, preferably drill bits, preferably drill bits 20 arranged according to size. Additionally, tool bit panel 14 is shown as having side walls 80 having metal extrusions or pivot protrusions 82 for pivotally connecting tool bit panel 14 to housing 12. Preferably, bottom portion 22 includes a pivot tab 84 and a boss 85 which define pivot holes 86 for receiving protrusions 82. The pivot protrusions 82, tabs 84, bosses 85 and holes 86, allow tool bit panel 14 to rotate away from back panel 30 when tool bit index 10 is in an open position as shown in FIG. 2. During assembly of the preferred tool bit index 10, the pivot protrusions 82 can be created before the panel 14 is forced into place in the housing 12 by deforming portions of the housing or, in alternate embodiments, the panel could be placed in position within the housing 12, and the protrusions could be created while the panel is held in place within the housing, thereby reducing the need to deform the housing 12 to insert the tool bit panel 14.

It will be appreciated that an alternate tool bit index (not shown) can be made using the alternate housing 12' shown in FIG. 9, and that while some of the parts of such an index will be in different positions with respect to other parts of the same, the function of the various parts will work together in a generally similar manner overall to provide an index which will work in roughly the same manner as the preferred index with differences due to relative changes in position of the various parts.

In yet other alternative embodiments (not shown in the Figures), tool bit panel 14 may comprise molded fingers (not shown) extending from a back of an alternate panel (not shown) for grasping and holding in place, individual tool bits. Similarly, these fingers could be molded onto a substantially planar tool bit holder board (not shown) having pivot protrusions similar to those described in the preferred embodiment to allow the board to pivot outwardly around pivot holes 86.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

What is claimed is:

1. A display container for retaining retail merchandise, the display container comprising:

a housing having a bottom portion having a plurality of sides and a top portion which can engage the bottom portion to form an enclosure within which the retail merchandise can reside, the housing being in a closed orientation when the top portion is so engaged with the bottom portion;

the top portion being interconnected with one of said plurality of sides of the bottom portion such that the top portion can engage the bottom portion to form the enclosure;

the housing having a snap closure mechanism, the snap closure mechanism having first and second elements, the first element being a part of a first portion of the housing and the second element being a part of a second portion of the housing, the first portion being selected from one of the group consisting of the top portion and the bottom portion, and the second portion being the other one of said group;

the first element including a latch strap, the latch strap being an extension of the first portion and having a strap surface extending away from the first portion, the latch strap further including a catch protruding away from the strap surface to define a catch face generally extending away from the strap surface at an angle of about 90°, the second element including a lip on the second portion over which the latch strap can extend when the top portion is engaged with the bottom portion to form the enclosure, wherein the catch face of the first element can engage the lip of the second element such that the latch strap engages the lip and holds the enclosure in the closed orientation;

the second portion further including a containment bridge under which at least an end portion of the latch strap extends when the latch strap engages the lip, the containment bridge extending from a first location to a second location on the second portion proximate the lip, and generally restricting the movement of the strap away from the lip when the catch face is engaged with the lip such that the catch face cannot be disengaged from the lip without destroying the containment bridge because the strap is held generally in place by the containment bridge.

2. The display container of claim 1, wherein the housing is made of a synthetic polymeric material through which retail merchandise contained within the housing can be seen.

3. The display container of claim 2, wherein the housing contains a tool bit display panel for receiving, retaining and displaying tool bits; a lower portion of the tool bit display panel being pivotally interconnected with the bottom portion of the housing such that the tool bit panel can pivot with respect to the bottom portion, thereby affording improved access to an upper portion of the tool bit panel when the top portion of the housing is not engaged with the bottom portion to form the enclosure and the upper portion of the panel is pivoted away from the bottom portion; the tool bit panel having a plurality of tool bit receiving receptacles for receiving and retaining tool bits.

4. The display container of claim 3, wherein the housing includes a living hinge connecting the top portion with the bottom portion.

5. The display container of claim 3, wherein the housing includes a pair of protrusion receiving openings in the bottom portion of the housing and the display panel is made of a metal material, the panel having a pair of extruded metal protrusions extending outwardly from opposite sides of the panel, the metal extrusions being seated within respective extrusion receiving openings to enable the panel to pivot with respect to the bottom portion.

6. The display container of claim 3, the housing having a top surface and a bottom surface and four sides, three of the sides being generally oriented at an angle of about 90° with respect to at least one of the other sides and the fourth side being oriented at angles with respect to each of the other sides which are other than 90°.

7. The display container of claim 1, the housing including a tab having a hook receiving receptacle for hang the index on a display hook.

8. The display container of claim 1, wherein the housing is made of a synthetic polymeric material, so that parts of the housing can be cut and separated from the remaining parts housing, the containment bridge being severable such that the strap can be pull away from the lip, thereby disengaging the catch face from the lip and permitting the disengagement of the top portion from the bottom portion.

9. A display container for retaining a plurality tool bits, the display container comprising:

a housing and a tool bit panel for receiving tool bits; the housing including a bottom portion having a plurality of sides and a top portion which can engage the bottom portion to form an enclosure within which the tool bit panel can reside, the housing being in a closed orientation when the top portion is so engaged with the bottom portion;

the top portion being interconnected with one of said plurality of sides of the bottom portion such that the top portion can engage the bottom portion to form the enclosure;

a lower portion of the tool bit panel being pivotally interconnected with the bottom portion of the housing such that the tool bit panel can pivot with respect to the bottom portion, thereby affording improved access to an upper portion of the tool bit panel when the top portion of the housing is not engaged with the bottom portion to form the enclosure and the upper portion of the panel is pivoted away from the bottom portion;

the tool bit panel having a plurality of tool bit receiving receptacles for receiving and retaining tool bits;

the housing having a snap closure mechanism, the snap closure mechanism having first and second elements, the first element being a part of a first portion of the housing and the second element being a part of a second portion of the housing, the first portion being selected from one of the group consisting of the top portion and the bottom portion, and the second portion being the other one of said group;

the first element including a latch strap, the latch strap being an extension of the first portion and having a strap surface extending away from the first portion, the latch strap further including a catch protruding away from the strap surface to define a catch face generally extending away from the strap surface at an angle of about 90°, the second element including a lip on the second portion over which the latch strap can extend when the top portion is engaged with the bottom portion to form the enclosure, wherein the catch face of the first element can engage the lip of the second element such that the latch strap engages the lip and holds the enclosure in the closed orientation;

the second portion further including a containment bridge under which at least an end portion of the latch strap extends when the latch strap engages the lip, the containment bridge extending from a first location to a second location on the second portion proximate the lip, and generally restricting the movement of the strap away from the lip when the catch face is engaged with the lip such that the catch face cannot be disengaged from the lip without destroying the containment bridge because the strap is held generally in place by the containment bridge.

10. The display container of claim 9, wherein the housing is made of a synthetic polymeric material through which the tool bit panel contained within the housing can be seen by a person without using vision enhancement equipment.

11. The display container of claim 10, wherein the housing includes a living hinge connecting the top portion with the bottom portion.

12. The display container of claim 9, wherein the housing has a pair of protrusion receiving openings and the panel is made of a metal material, the panel having a pair of extruded metal protrusions extending outwardly from opposite sides of the panel, the metal extrusions being seated within respective extrusion receiving openings to enable the panel to pivot with respect to the bottom portion.

13. The display container of claim 9, the housing including a tab having a hook receiving receptacle for hang the index on a display hook.

14. The display container of claim 9, the housing having a top surface and a bottom surface and four sides, three of the sides being generally oriented at an angle of about 90° with respect to at least one of the other sides and the fourth side being oriented at angles with respect to each of the other sides which are other than 90°.

15. The display container of claim 9, wherein the housing is made of a synthetic polymeric material, so that parts of the housing can be cut and separated from the remaining parts housing, the containment bridge being severable such that the strap can be pull away from the lip, thereby disengaging the catch face from the lip and permitting the disengagement of the top portion from the bottom portion.

* * * * *